United States Patent [19]

Sato et al.

[11] 4,274,624

[45] Jun. 23, 1981

[54] DUAL-MODE SHEET SORTING APPARATUS

[75] Inventors: Tadashi Sato, Kokubunji; Shigeru Yoshimura, Yokohama; Kiyomichi Ichikawa, Kawasaki, all of Japan

[73] Assignee: Canon Kabushiki Kaisha, Tokyo, Japan

[21] Appl. No.: 89,456

[22] Filed: Oct. 30, 1979

[30] Foreign Application Priority Data

Oct. 30, 1978 [JP] Japan ..... 53/133374
Oct. 30, 1978 [JP] Japan ..... 53/133375
Nov. 16, 1978 [JP] Japan ..... 53/141388

[51] Int. Cl.[3] ..... B65H 31/24; B65H 39/11

[52] U.S. Cl. ..... 271/292; 271/294; 271/297; 271/213

[58] Field of Search ..... 271/292, 293, 294, 295, 271/297, 287, 288, 289, 290, 279, 213; 270/58

[56] References Cited

U.S. PATENT DOCUMENTS 3,273,882 9/1966 Pearson ..... 271/292
3,995,748 12/1976 Looney ..... 271/293 X
4,026,540 5/1977 Lawrence ..... 271/297 X

*Primary Examiner*—Bruce H. Stoner, Jr.
*Attorney, Agent, or Firm*—Fitzpatrick, Cella, Harper & Scinto

[57] ABSTRACT

A dual-mode sheet sorting apparatus for sorting plural sheets into plural storage bins according to a predetermined order. The apparatus includes first bin members for storing sorted sheets, movable second bin members for storing sorted sheets and having a number corresponding to the number of the first bin members, and selecting device for selectively placing the second bin members in a storage position for receiving the sheets or in a retracted position in which the second bin members are retracted from the storage position, such that in a first operation mode the second bin members are displaced to the retracted position by the selecting device to allow sheet sorting into the first bin members, while in a second operation mode the second bin members are displaced to the storage position by the selecting device to allow sheet sorting into the second bin numbers in preference to the first bin members.

6 Claims, 9 Drawing Figures

DUAL-MODE SHEET SORTING APPARATUS

BACKGROUND OF THE INVENTION

1. Field of the Invention

The present invention relates to a dual-mode sheet sorting apparatus for sorting the sheets emitted from a copier or a duplicator, and more particularly to a sheet sorting apparatus provided with a first mode sheet storage section for ordinary sheet sorting and a second mode sheet storage section capable of automatic sheet sorting in preference to the first mode operation when necessitated or after the completion of operation in the first mode.

2. Description of the Prior Art

The conventional sheet sorting apparatus have been designed to sort, page after page, the sheets emitted from a copier or a duplicator into suitable sorting trays, but the recent image forming apparatus such as copiers designed for a higher speed and a higher working efficiency are now provided with multiple functions, including so-called "cut-in" and "reservation" functions, to which the sorting apparatus are also required to respond.

The "cut-in" is a function to enable the copier to interrupt the copying operation in case of an urgent need for another copying and to restart the interrupted copying operation after the completion of a desired number of urgent copies.

Also, the "reservation" is a function to enter, during a copying operation with an automatic original feeder, the copying conditions of a next user, thereby automatically conducting, upon completion of said copying operation, the copying operation for said next user.

However, such cut-in function performed in a conventional apparatus often results in the mixing-up of the copy sheets for such urgent copying with those of the interrupted copying operation. Particularly in case a sheet sorting apparatus is in use, the sheets for such urgent copying are mixed into the sheets already sorted, and for this reason it has been necessary in the cut-in function to manually extract such mixed sheets from the sorting apparatus or to insert suitable markers such as colored sheets in advance of the urgent copy function.

Also in the reservation function, because of the similar inconvenience, the next user has to wait until the completion of the preceding copying operation.

Already there is known, as disclosed in the Japanese Utility Model Publication No. Sho53-7765, a sorting apparatus in which the sorted sheets are displaced by a pushing mechanism from a storage position to a take-out position, but such mechanism is not suitable for a copier provided with the cut-in function and hence does not solve the above-mentioned inconvenience since the sheets, once displaced by said pushing mechanism at the interruption of the copying operation, cannot be returned to the original storage position.

SUMMARY OF THE INVENTION

The present invention has been conceived to overcome the above-mentioned drawbacks and to provide a sheet sorting apparatus easily adaptable to the cut-in and reservation copying modes.

Therefore, the principal object of the present invention is to provide a dual-mode sheet sorting apparatus provided with a first mode sheet storage section for ordinary sheet sorting and a second mode sheet storage section for automatic sheet sorting in preference to the first mode operation when necessitated or after the completion of the first mode operation.

Also in contrast to the conventional sorting apparatus provided with a number of storage bins corresponding to the number of copies ordinarily made, the sorting apparatus of the present invention is capable of storing, in the second mode storage section, the sheets eventually overflowing the first mode storage section.

Thus, another object of the present invention is to provide a dual-mode sheet sorting apparatus capable of storing, in the second mode storage section, the sheets eventually overflowing the first mode storage section.

Still another object of the present invention is to provide a sheet sorting apparatus capable of accommodating various functions without increasing the volume of the apparatus.

More specifically, in case of the cut-in copying function, the sorting apparatus of the present invention performs the sorting operation with the fixed storage bins of the first mode storage section until the copying operation is interrupted for the cut-in function, but movable bins of the second mode storage section descend or ascend immediately before the start of the cut-in copying to enable the second mode in which the sheets are sorted into said movable bins in preference to the first mode, and said movable bins are returned to the original position upon completion of the cut-in operation to continue the interrupted copying operation in the first mode.

Also in case the automatic original feeder provided with the reservation function receives, during a copying operation, the entry of the copying conditions for a next user, the movable bins of the second mode storage section automatically descend or ascend upon completion of the sorting with the first mode storage section for the copying currently under way, whereby the copies made with the previously entered conditions for the next user are automatically sorted into said movable bins of the second mode storage section.

Also in case the number of copies to be sorted is in excess of the maximum number acceptable for the first mode storage section, the sheets are at first sorted into the fixed bins of the first mode storage section, and, when they become full, the movable bins of the second mode storage section automatically descend or ascend to enable operation in the second mode wherein the overflowing sheets are placed in said movable bins.

Still another object of the present invention is to provide a dual-mode sheet sorting apparatus wherein plural trays are grouped into two sets which can be independently displaced to the front or to the back, whereby either set, having completed the sorting operation, can be automatically displaced to the front or to a lateral direction.

Still another object of the present invention is to provide a dual-mode sheet sorting apparatus in which two sets of sorting trays are alternately used.

Still another object of the present invention is to provide a dual-mode sheet sorting apparatus provided with N sorting trays divided into two independently controllable sets each composed of N/2 sorting trays, wherein said two sets are alternately used in case the number of copies does not exceed N/2 while said two sets are used in combination for sorting in the ordinary manner when the number of copies is within a range from N/2 to N.

Still other objects of the present invention will be made clear from the following description on an embodiment of the present invention, which however is given only as an example and by no means limits the present invention.

DESCRIPTION OF THE PREFERRED EMBODIMENTS

Figure 1:
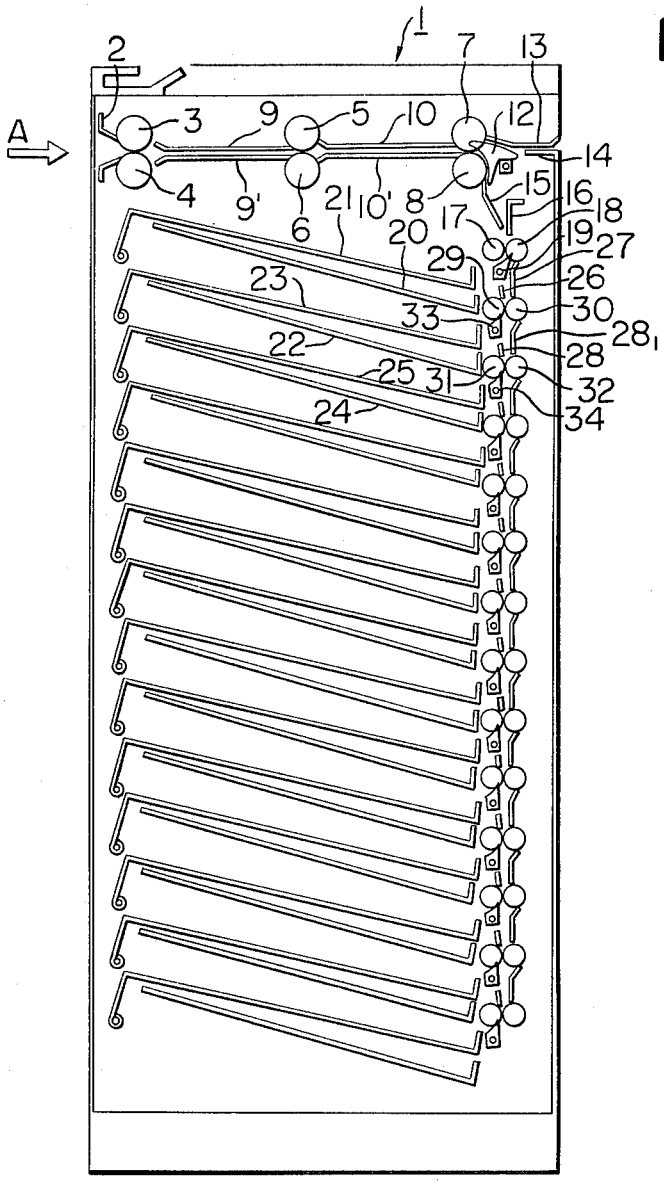
FIG. 1 is a lateral cross-sectional view of an embodiment of the apparatus of the present invention.

FIG. 1 shows, in a lateral cross-sectional view, an embodiment of the dual-mode sheet sorting apparatus 1 of the present invention, wherein the sheets to be sorted, supplied along a direction indicated by the arrow A from an image forming apparatus such as a copier, are guided by an entrance guide 2, paired feed rollers 3–4, 5–6, 7–8 and paired guide plates 9–9', 10–10' and diverted by a main diverting plate 12 toward sheet storage sections composed of fixed and movable bins to be explained later. In case the principal diverting plate 12 is not actuated for example by a plunger, the sheets are forwarded through guide plates 13, 14 to an unrepresented additional sheet sorting apparatus. The sheets diverted by said principal diverting plate 12 are guided by guide plates 15, 16 and rollers 17, 18 are stored in fixed bins 20 or movable bins 21 after being diverted by an auxiliary diverting plate 19. Said fixed bins and movable bins are arranged in multiple steps as illustrated, and guide plates 26, 27, 28, $28_1$, . . . , rollers 29–30, 31–32, . . . , and auxiliary diverting plates 33, 34, . . . are provided respectively corresponding to the pairs of fixed bins and movable bins 20–21, 22–23, 24–25, . . . The auxiliary diverting plates 19, 33, 34, . . . are actuated in succession by plungers or cams by signals related to the original thereby selecting the fixed bins or movable bins into which the sheets are to be inserted.

Figure 2:
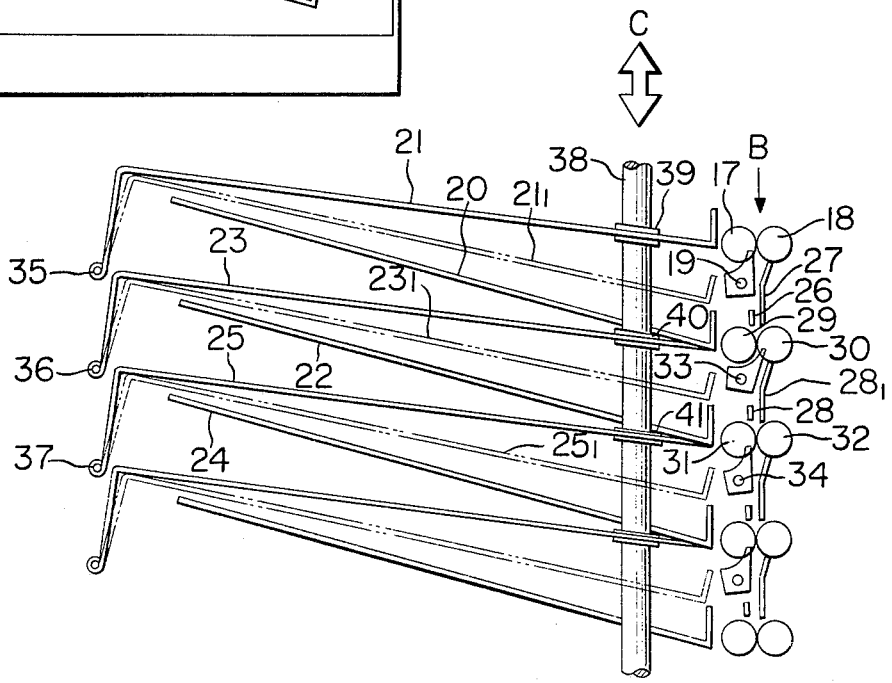
FIG. 2 is an enlarged partial cross-sectional view of the sheet storage bins.

In the following there will be given an explanation on the fixed bins 20, 22, 24, . . . and movable bins 21, 23, 25 . . . , referring to FIG. 2 showing a part of the fixed bins and movable bins constituting the sheet storage units in an enlarged partial cross-sectional view. A sheet storage unit for receiving the sheet supplied in the direction of arrow B and diverted by the auxiliary diverting plate 19 is composed of a first fixed bin 20 and a first movable bin 21, wherein said first movable bin 21 is selectively movable about a shaft 35 between a storage position $21_1$ (chain-lined position in FIG. 2) for receiving the sheets in the second mode and a retracted position 21 (full-lined position in FIG. 2) for the first mode. Similarly there are provided a second sheet storage unit composed of a second fixed bin 22 and a second movable bin 23 for receiving the sheets diverted by the auxiliary diverting plate 33, a third sheet storage unit composed of a third fixed bin 24 and a third movable bin 25 for receiving the sheets diverted by the auxiliary diverting plate 34 and so on, wherein said movable bins 23, 25 being respectively movable between storage positions $23_1$, $25_1$ and retracted positions 23, 25 as shown in FIG. 2. Said movable bins 21, 23, 25 are linked, through flexible bushings 39, 40, 41 provided in the vicinity of sheet entrances thereof, to a rod 38 which is reciprocated in the direction of arrow C thereby to selectively place said movable bins at the same time in the storage positions or retracted positions thereof.

Said sheet storage units can be provided in a number required by the type of copier to be used in combination, and the selection of sheet storage position can be controlled by auxiliary diverting plates as explained in the foregoing. In FIG. 2 there is shown a state in which the sheets can be introduced into the second sheet storage unit, i.e. the second fixed bin 22 or the second movable bin $23_1$.

Figure 3:
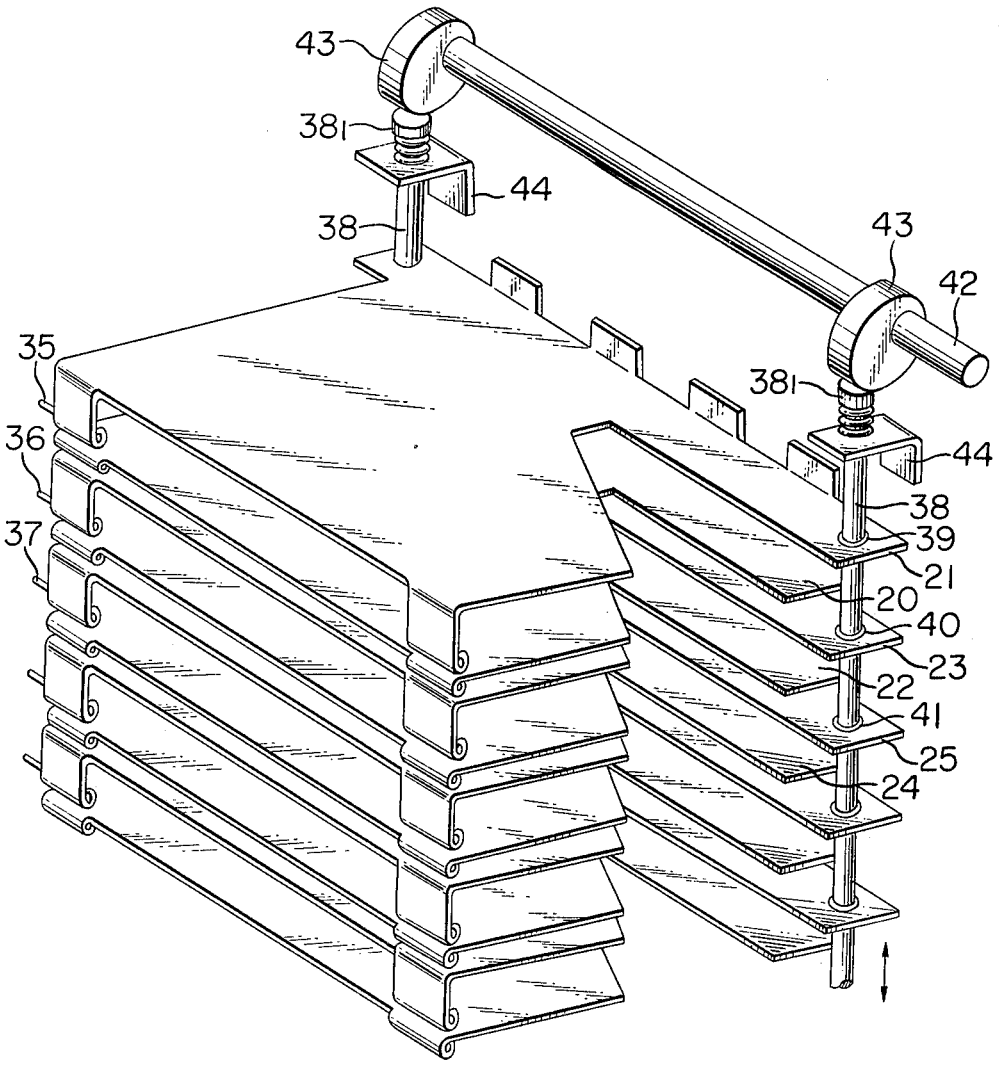
FIG. 3 is a perspective view of the actuating mechanism for selecting the first and second modes.

In the following there will be given an explanation on the actuating mechanism for selecting the first mode and the second mode of the sorting apparatus, while referring to FIG. 3 showing said actuating mechanism in a perspective view. As already explained in the foregoing, the first or second mode of the sheet sorting apparatus is realized respectively when the movable bins shown in FIG. 2 are located in the retracted positions or storage positions, and such selective positioning of the movable bins is achieved by reciprocating motion of rods 38 for supporting said movable bins 21, 23, 25, . . . by means of cams 43 integrally rotating with a shaft 42 and engaging with the ends $38_1$ of said rods 38.

Between said ends $38_1$ and bearing plates 44 there are provided springs 45 to constantly bias the rods 38 upwards.

Figure 4:
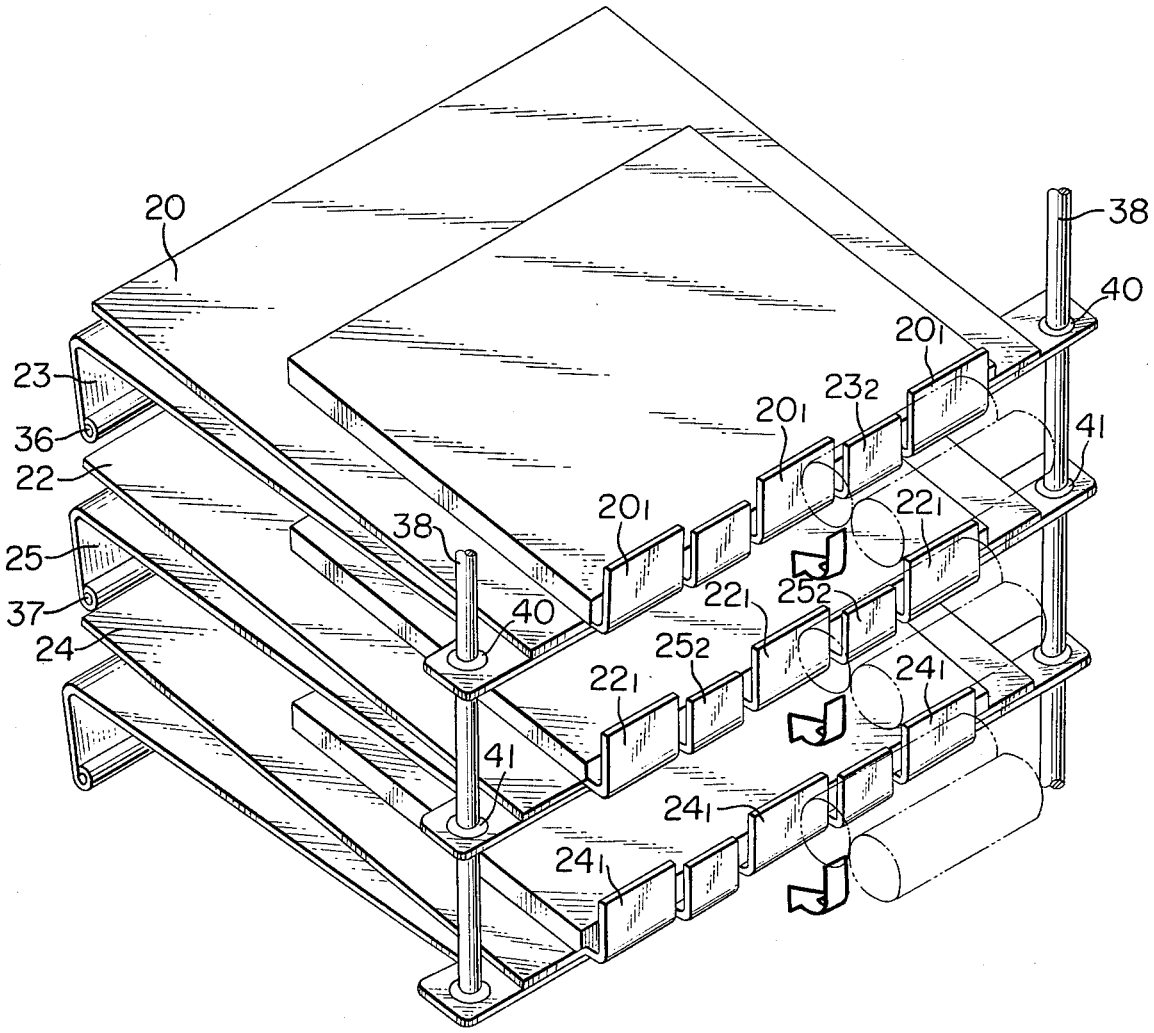
FIG. 4 is a perspective view of the sheet storage sections wherein the movable bins are in the retracted position.
Figure 5:
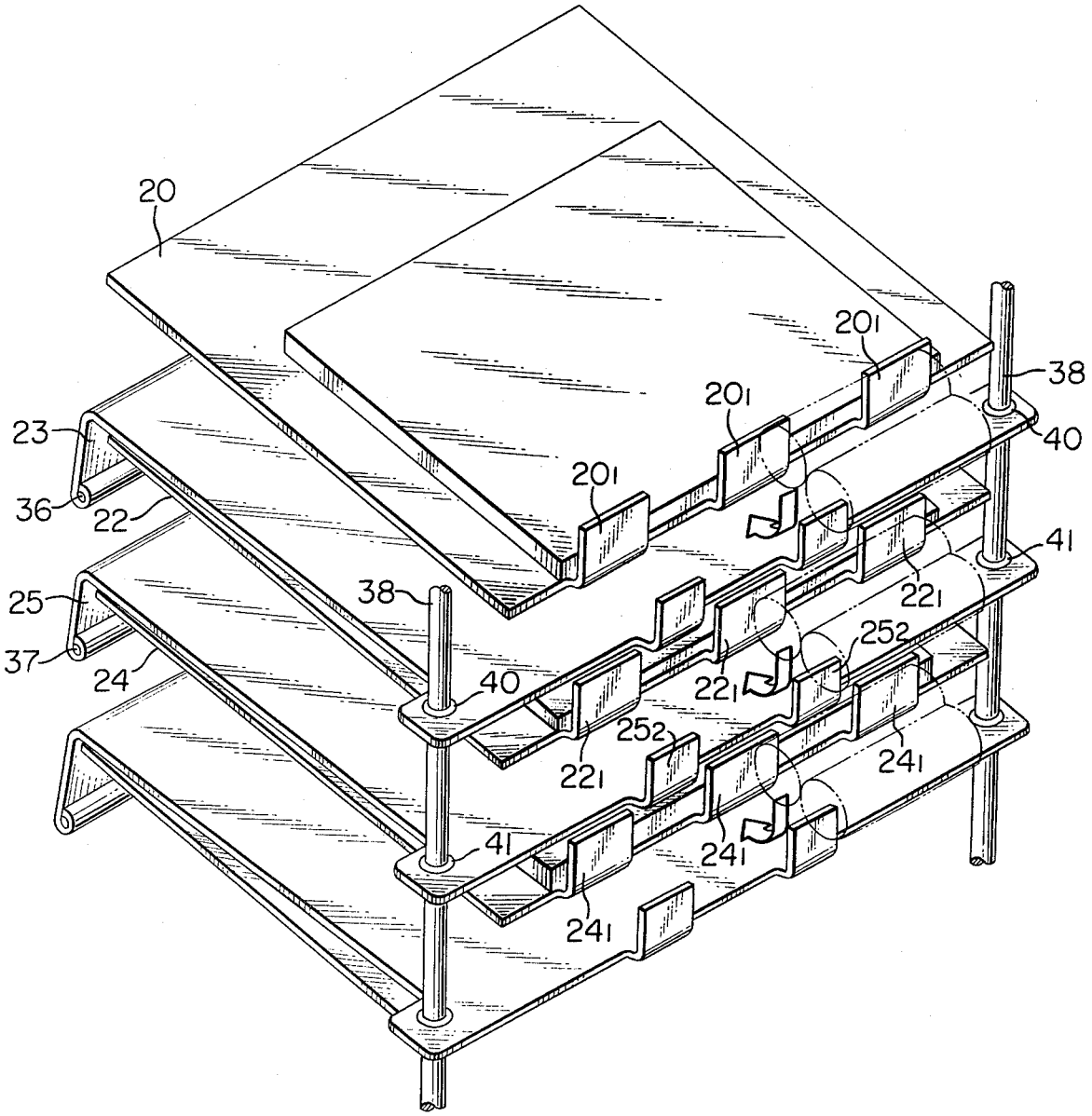
FIG. 5 is a perspective view of the sheet storage sections wherein the movable bins are in the sheet receiving position.

In the following there will be explained, with reference to FIGS. 4 and 5, the positioning of vertical tab portions provided at the sheet entrance ends of the fixed and movable bins. FIGS. 4 and 5 respectively show, both in perspective views, the sheet storage units wherein the movable bins are in the retracted positions or in the storage positions. The transported sheets are diverted by the corresponding auxiliary diverting plate and stored on a fixed bin or a movable bin, wherein said vertical tabs function to align an end of the sheets on said bins. In the first mode shown in FIG. 4, in which the first movable bin is omitted for the purpose of clarity, the movable bin 23 is in the retracted position wherein the vertical tabs $23_2$ thereof are inserted into the spaces between the vertical tabs $20_1$ of the fixed bin 20 to receive the sheets on said fixed bin 20. In this manner the movable bins in the retracted position are superposed on the fixed bins without hindering the function thereof. Also the vertical tabs $23_2$ of the movable bin 23 are slightly inclined toward the roller in comparison with the vertical tabs $20_1$ of the fixed bin 20 in order that said tabs $23_2$ do not hinder the function in the retracted position of the movable bin 23.

In addition the shaft 36 should be placed in an appropriate position in such a manner that the movable bin 23 does not come into contact with the rollers and still is capable of providing an effective space to the fixed bin. The foregoing explanation also applies to the other shown movable bin 25, other fixed bins 22, 24 and vertical tabs $25_2$, $22_1$, $24_1$ thereof. In the second mode shown in FIG. 5, the movable bin 23 is located in the storage position $23_1$ shown in FIG. 2, wherein the vertical tabs $23_2$ thereof are separated from the vertical tabs $20_1$ of the fixed bin 20 to allow the introduction of sheets therebetween, whereby the sheets on said movable bin 23 are aligned by said vertical tabs $23_2$.

The foregoing explanation applies also to another movable bin 25 and the vertical tabs $25_2$ thereof.

As explained in the foregoing, the first mode of the sorting apparatus is achieved by the displacement of the movable bins to the retracted positions thereof wherein the sheets are sorted into the fixed bins, while the second mode is achieved by the displacement of the movable bins to the storage positions thereof wherein the sheets are sorted not into the fixed bins but into the movable bins. The selection of the first or second mode is controlled by the rotation of the shaft 42 (FIG. 3) in response to the signals in relation to the copier functions such as "cut-in", "reservation" and "overflow".

The above-explained embodiment in which the sheet storage section for the first mode and that for the second mode can meet the requirements of the "cut-in", "reservation" and "overflow" functions, achieves the aforementioned objects of the present invention by arbitrary selection of an independent sheet storage section in addition to the ordinary sheet sorting function.

Figure 6:
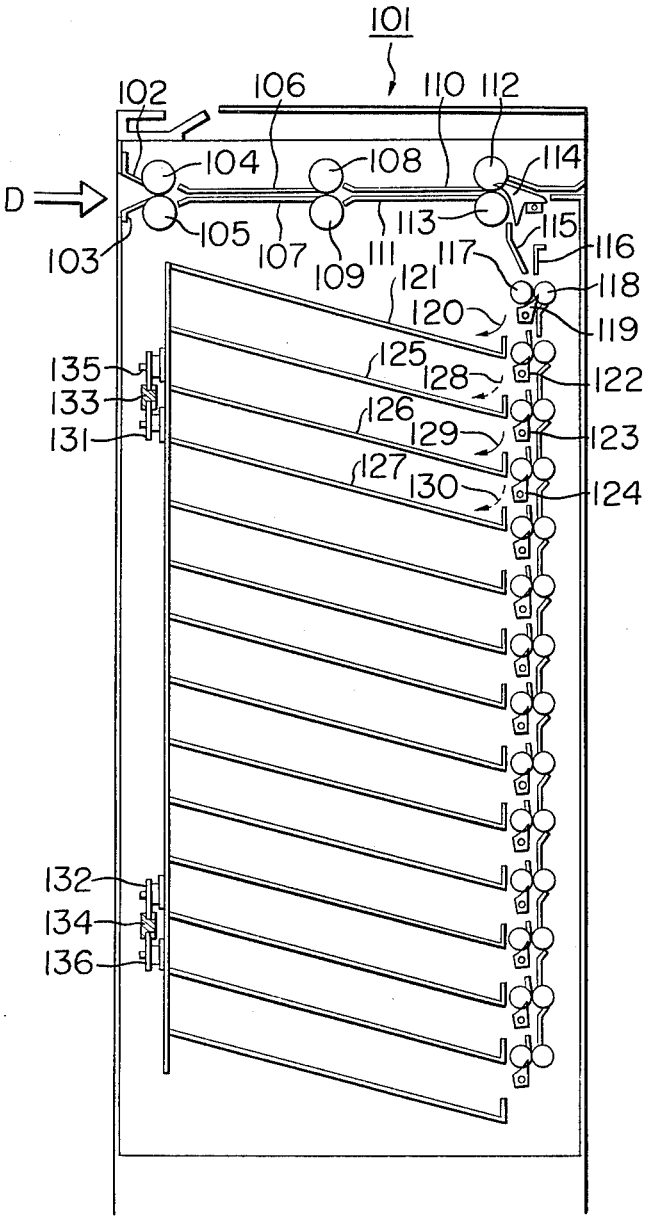
FIG. 6 is a lateral cross-sectional view of another embodiment of the present invention.

FIG. 6 shows, in a lateral cross-sectional view, another embodiment of the dual-mode sheet sorting apparatus 101 of the present invention, wherein the sheets to be sorted, supplied along a direction indicated by the arrow D from an image forming apparatus such as a copier, are guided by entrance guides 102, 103, feed rollers 104, 105, intermediate guides 106, 107, feed rollers 108, 109, intermediate guides 110, 111 and feed rollers 112, 113 and diverted by a principal diverting plate 114 toward the sheet storage sections composed of bins to be explained later. In case the principal diverting plate 114 is not actuated as shown in FIGS. 6 for example by a plunger, the sheets are forwarded further to a similar additional sheet sorting apparatus which is added to the sorting apparatus 101 for the sheet sorting of a larger volume. The sheets diverted by said principal diverting plate 114 are guided by guides 115, 116 and first rollers 117, 118, then diverted by a first auxiliary diverting plate 119 into a direction indicated by the full-lined arrow 120 and stored in a first bin 121. Said first diverting plate 119 is anticlockwise biased in the normal state, and one of such diverting plates is selectively rotated clockwise for example by a plunger in response to suitable control means to store the sheets in a selected bin.

FIG. 6 shows a state in which the first diverting plate 119 is pivoted in the clockwise direction. In the similar manner the sheet storage into the second bin 125, third bin 126, fourth bin 127, . . . can be achieved by actuating either one of the second diverting plate 122, third diverting plate 123, fourth diverting plate 124, etc. by the control means. The control is achieved in such a manner that said bins can be used in two separate sets, namely a first set of the first bin 121, third bin 126 etc. (hereinafter called odd bin set) corresponding to the full-lined arrows 120, 129 etc. and a second set of the second bin 125, fourth bin 127 etc. (hereinafter called even bin set) corresponding to the broken-lined arrows 128, 130 etc. In addition said first and second sets are respectively rendered displaceable in the lateral or forward direction with respect to the direction of sheet introduction. The first set of odd-numbered bins 121, 126, . . . is displaced by rollers 131, 132 rotatably mounted on the forward end wall thereof and engaging with grooved guide members 133, 134 while the second set of even-numbered bins 125, 127, . . . is displaced by similar rollers 135, 136 also engaging with said grooved guide members 133, 134.

Figure 7:
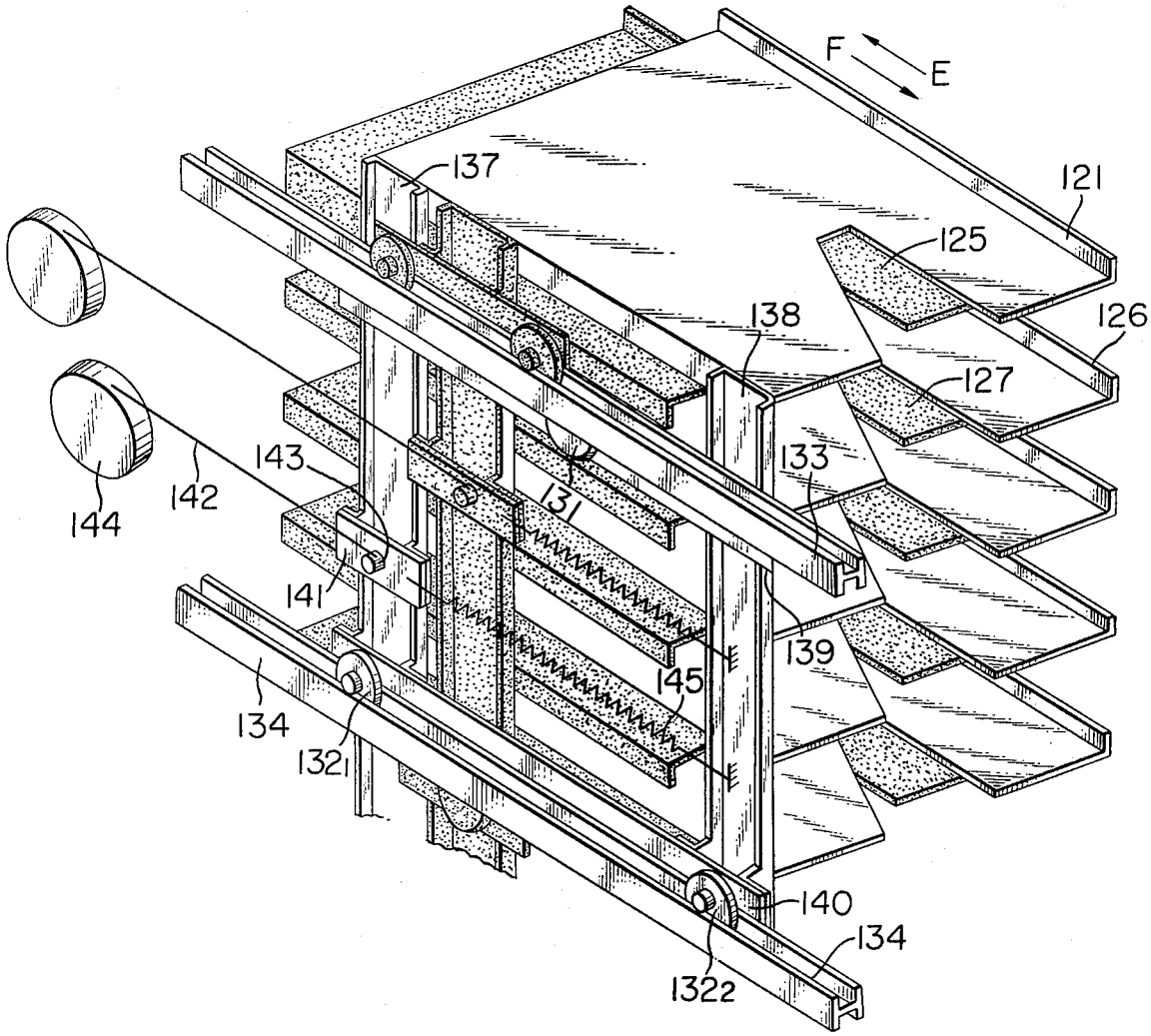
FIG. 7 is a perspective view of the sets of bins wherein the set of bins of odd number is laterally displaced.

The above-explained displacing function will be explained further by FIGS. 7 and 8, which respectively show, both in perspective views, the state in which the first odd bin set or the second even bin set is laterally displaced. Referring to FIG. 7, the odd-numbered bins 121, 126, . . . in the first set are mounted on connecting frames 137, 138 which are in turn connected in horizontal direction by roller plates 139, 140 rotatably supporting rollers 131 and $132_1$, $132_2$ respectively thereon, said rollers being rendered displaceable in the lateral direction along grooved guide rails 133, 134 fixed on the body of the sorting apparatus. Also the connecting frame 137 is provided with a wire mounting plate 141 with a wire pin 143 holding an end of a wire 142 which is at the other end wound on a wire pulley 144. An unrepresented drive source such as a motor rotates said pulley 144 to take up the wire 142, thereby causing the displacement of the set of odd-numbered bins 121, 126, . . . in the direction of arrow E. The returning displacement in the direction of arrow F is achieved by a spring 145 mounted at an end thereof on said wire mounting plate 141 and at the other end on the body of the sorting apparatus. At the displacement in the direction E the rotation of the wire pulley 144 generates a biasing force in the spring 145, which causes the returning displacement with the reverse rotation of said wire pulley 144. During these displacements the second of even-numbered bins 125, 127, . . . is maintained in the position for receiving the sorted sheets.

Figure 8:
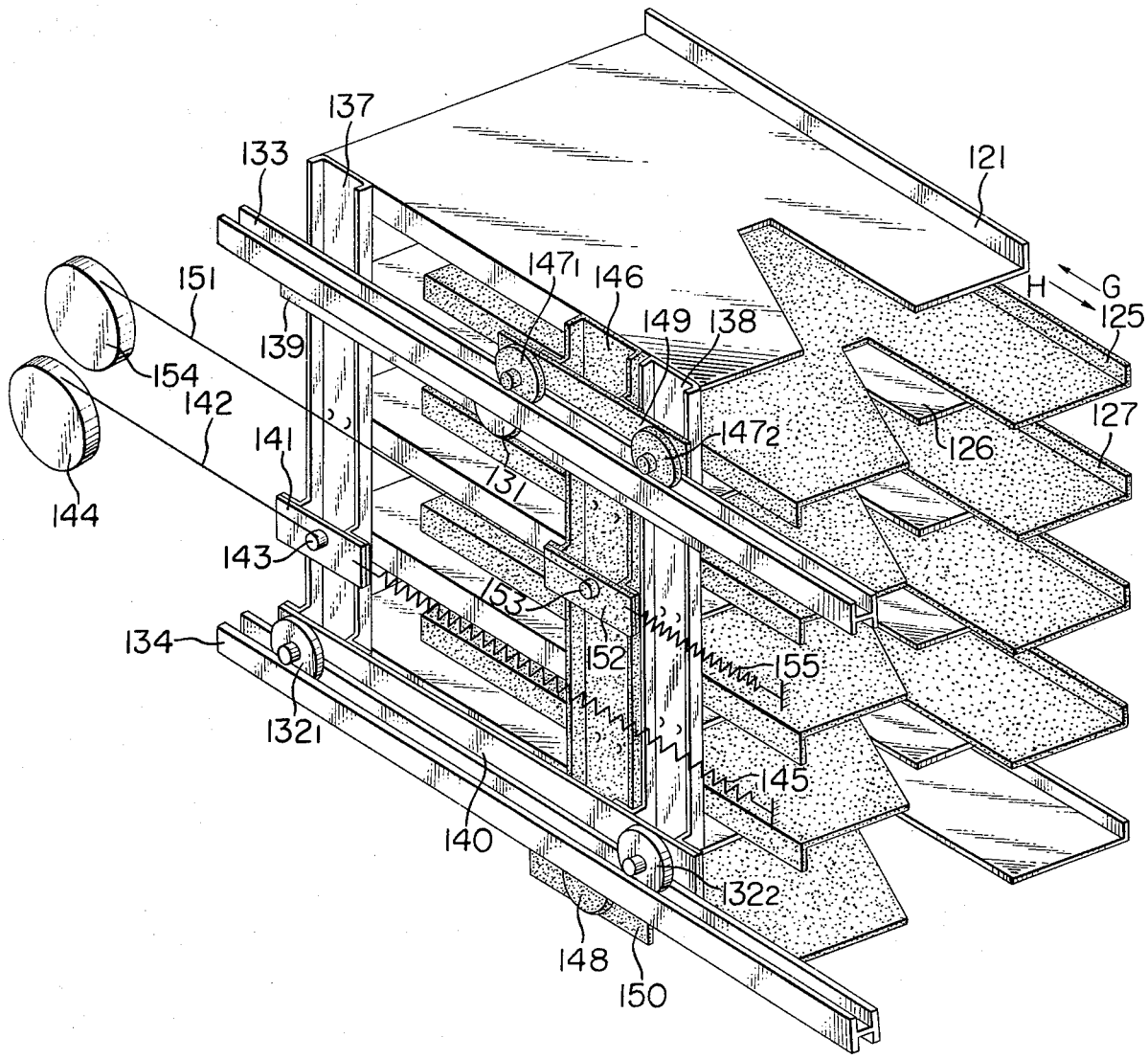
FIG. 8 is a perspective view of the sets of bins wherein the set of bins of even number is laterally displaced.

FIG. 8 shows the displacement of the second even bin set. The even-numbered bins 125, 127, . . . in the second set are mounted on a connecting 146 which is provided with roller plates 149, 150 rotatably supporting rollers $147_1$, $147_2$ and 148 respectively thereon. Thus, similar to the first odd bin set, the second even bin set is rendered displaceable along the grooved guide rails 133, 134 mounted on the body of the sorting apparatus. Also the connecting frame 145 is provided with a wire mounting plate 152 with a wire pin 153 holding an end of a wire 151 which is at the other end wound on a wire pulley 154, whereby an unrepresented drive source such as a motor rotates said wire pulley 154 to take up said wire 151 thereby causing integral displacement of the set of even-numbered bins 125, 127, . . . in the direction of arrow G.

Also the returning displacement in the direction of arrow H is achieved in a similar manner as in the case of the aforementioned odd bin set by a spring 155 which is mounted at an end thereof on said wire mounting plate 152 and at the other end on the body of the sorting apparatus. During the displacement shown in FIG. 8, the first set of the odd-numbered bins 121, 126, . . . is maintained in the position for receiving the sorted sheets.

The above-explained displacement of bin sets can naturally be achieved not only by the combination of the wire and wire pulley as shown in the foregoing embodiment but also by other various mechanisms such as various link mechanisms or a linear motor.

Figure 9:
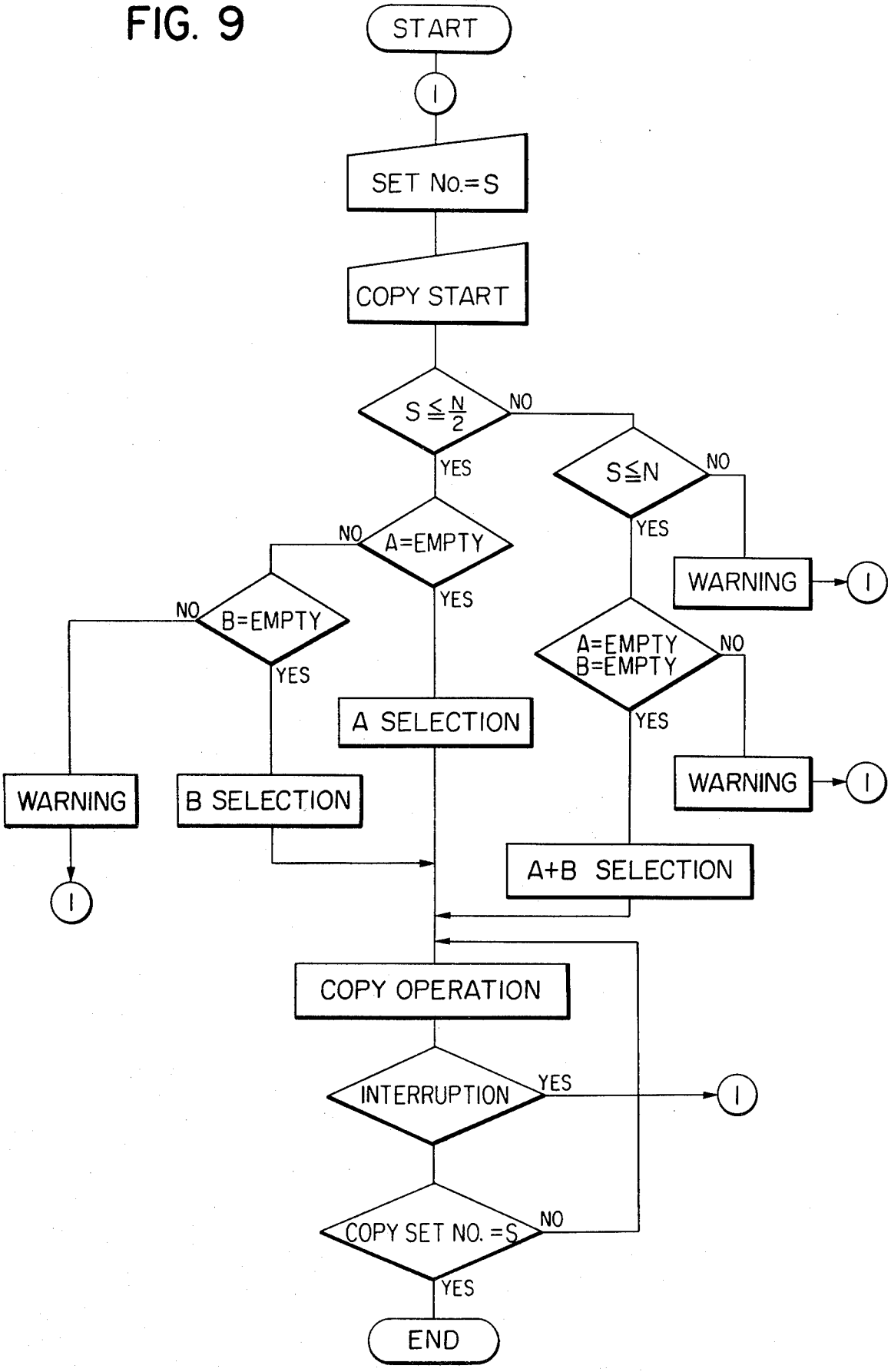
FIG. 9 is a flow chart showing the function sequence of the apparatus of the present invention.

Now the function sequence of this embodiment will be explained by the chart shown in FIG. 9. Upon actuation of a copy start button after entering a copy set number S into the copier, there is conducted a comparing step to identify whether said set number S is in excess of a half of the bin number N of the sorting apparatus. In case of $S \leqq N/2$, there is conducted a detection step to identify whether the first odd bin set (hereinafter called set A) is empty, and, if empty, the mechanism is switched to select the set A for the sheet sorting. In case the set A is not empty, there is conducted a detection step to identify whether the second even bin set (hereinafter called set B) is empty, and, if empty, the mechanism is switched to select the set B for the sheet sorting while, if not empty, there will be given an alarm for example by a buzzer.

On the other hand in case of $S > N/2$, there are conducted a detection step to identify if said set number S does not exceed the total bin number N and, if $S \leqq N$, another detection step to identify whether the sets A and B are both empty, and, still if so both of the sets A and B are selected for the sheet sorting.

In case of $S > N$ an alarm will be given, for example by a buzzer, for informing or the inability for sorting, while a similar alarm will be given also in case either the set A or the set B is not empty.

The copying operation is initiated after the confirmation of the above-mentioned functions, i.e. after either one or both of the sets are selected. In case of an urgent cut-in copying, the copying operation is interrupted to accommodate the cut-in copying under a similar control, and is thereafter continued until the completion of a preset copy number is detected.

As explained in the foregoing, the storage bins of this embodiment are divided into a first set of odd-numbered bins and a second set of even-numbered bins which can be alternately displaced.

Thus, in case the copy set number S is not in excess of a half of the number N of said bins, the first set and the second set of bins are alternately used for sorting. Thus, when the bins of the first set are empty, the sheets are sorted into said first set, and, upon completion of said sorting, the sheets are sorted into the bins of the second set. It is possible to take out the sheets from said second set during the sorting operation into the first set. Thus, as these sets are alternately displaceable, it is possible to conduct the plural sorting operations in continuous manner, if desired, automatically with another control means.

Also in case the copy set number S is in excess of a half of the number N of said bins, both the first set and the second set are used in the sorting operation in the usual manner, both sets being displaced in succession after the completion of the sorting operation.

As explained in the foregoing, the dual-mode sheet sorting apparatus of the present embodiment provided with the bins of a first set and those of a second set which can be selectively used for sorting according to the circumstances is thus capable of easily responding to the requirements of "cut-in" and "reservation" functions, thereby preventing the drawbacks of the conventional apparatus and achieving the aforementioned objects of the present invention.

What we claim is:

1. A dual-mode sheet sorting apparatus, comprising:

first sheet storing means for storing sorted sheets, said first sheet storing means including a plurality of first bin members fixed to a frame of the apparatus;

second sheet storing means including a plurality of second bin members movable relative to said frame and disposed in alternating sequence with respect to said first bin members, the number of said second bin members corresponding to the number of said first bin members; and driving means for selectively moving said second sheet storing means relative to said frame and said first sheet storing means between a retracted position for permitting passage of the sheets into said first sheet storing means but blocking passage of the sheets into said second sheet storing means, and a storing position for permitting passage of the sheets into said second sheet storing means but blocking passage of the sheets into said first sheet storing means.

2. A dual-mode sheet sorting apparatus according to claim 1, wherein said second bin members are movable as a unit.

3. A dual-mode sheet sorting apparatus according to claim 2, wherein said second sheet storing means in its retracted position partially overlaps with said first sheet storing means.

4. A dual-mode sheet sorting apparatus according to claim 3, wherein each of said first and second bin members has a rising portion for registering one edge of each sheet, and, in the retracted position of said second sheet storing means, said rising portions of said first and second bin members overlap with each other.

5. A dual-mode sheet sorting apparatus, comprising:

first sheet storing means for storing sorted sheets and including a plurality of first bin members, said first sheet storing means being retractable from a sheet receiving position to a retracted position thereof;

second sheet storing means movable relative to said first sheet storing means and including a plurality of second bin members disposed in alternating sequence with respect to said first bin members and retractable from a sheet receiving position to a retracted position thereof, the number of said second bin members corresponding to the number of said first bin members; and guide means for moving, when said first sheet storing means is in a sheet receiving position, said second sheet storing means to a retracted position beyond said first sheet storing means, said guide means moving said first sheet storing means to a retracted position, when said second sheet storing means is in a sheet receiving position.

6. A dual-mode sheet sorting apparatus according to claim 5, wherein said guide means is adapted simultaneously to move both said first and second sheet storing means to their sheet receiving positions.

* * * * *